US008292118B2

(12) United States Patent
Ebesu

(10) Patent No.: US 8,292,118 B2
(45) Date of Patent: Oct. 23, 2012

(54) BALANCED INDIVIDUAL DINING PLATE

(76) Inventor: Duane Ebesu, Freeport, NY (US)

( * ) Notice: Subject to any disclaimer, the term of this patent is extended or adjusted under 35 U.S.C. 154(b) by 333 days.

(21) Appl. No.: 12/601,458

(22) PCT Filed: May 23, 2008

(86) PCT No.: PCT/US2008/064716

§ 371 (c)(1),
(2), (4) Date: Nov. 23, 2009

(87) PCT Pub. No.: WO2008/148005

PCT Pub. Date: Dec. 4, 2008

(65) Prior Publication Data

US 2010/0282760 A1 Nov. 11, 2010

Related U.S. Application Data

(60) Provisional application No. 60/940,112, filed on May 25, 2007, provisional application No. 61/161,511, filed on Mar. 19, 2009.

(51) Int. Cl.
*A47G 19/00* (2006.01)
*A47G 21/00* (2006.01)
*A24F 15/00* (2006.01)

(52) U.S. Cl. ..... 220/575; 206/562

(58) Field of Classification Search ..... 220/574, 220/574.1, 575; 206/557, 562, 563, 564, 206/1.7, 1.8; 294/144, 137, 164, 158, 172; D07/543; 248/309.1
See application file for complete search history.

(56) References Cited

U.S. PATENT DOCUMENTS

| | | | | |
|---|---|---|---|---|
| 2,307,882 | A * | 1/1943 | Freud et al. | 220/23.4 |
| 5,323,910 | A * | 6/1994 | van de Graaf, Jr. | 206/557 |
| 5,390,798 | A * | 2/1995 | Yanuzzi | 206/562 |
| 5,593,062 | A * | 1/1997 | Martin | 220/574.1 |
| 5,727,678 | A * | 3/1998 | Chen | 206/217 |
| 5,950,856 | A * | 9/1999 | Cinque | 220/23.4 |
| 6,264,026 | B1 * | 7/2001 | Bradley | 206/217 |
| 6,651,836 | B1 * | 11/2003 | Hofheins et al. | 220/575 |
| 7,121,422 | B2 | 10/2006 | Gitschlag et al. | |
| 2004/0074909 | A1 | 4/2004 | Gitschlag et al. | |
| 2005/0061821 | A1 | 3/2005 | Smith et al. | |
| 2008/0060559 | A1 | 3/2008 | Holland-Hinrichs | |

FOREIGN PATENT DOCUMENTS

| | | |
|---|---|---|
| JP | 3000149 | 8/1994 |
| JP | 7327805 | 12/1995 |
| JP | 2004181172 | 7/2004 |

OTHER PUBLICATIONS

PCT/ISA/237 Written Opinion issued in PCT/US2008/064716 (5pp).

* cited by examiner

*Primary Examiner* — Byron P. Gehman
*Assistant Examiner* — Shawn Braden
(74) *Attorney, Agent, or Firm* — The Farrell Law Firm, P.C.

(57) ABSTRACT

A plate that provides a handle area, a food-contact area, a transition area between the handle and food-contact areas, a cup hole, and first and second thumb holes adjacent to the cup hole. The cup hole of the plate, as well as the first and second thumb holes, are located within the handle area at different elevations from an elevation of the food-contact area of the plate.

12 Claims, 4 Drawing Sheets

BALANCED INDIVIDUAL DINING PLATE

PRIORITY

This application claims priority to U.S. Provisional Application No. 60/940,112, filed May 25, 2007, and to U.S. Provisional Application No. 61/161,511, filed Mar. 19, 2009, the contents of each which are incorporated herein by reference.

BACKGROUND OF THE INVENTION

The present invention relates to plates used for eating, and particularly to a formed plate that balances food with a beverage container support.

Conventional apparatus such the Disposable Plate Having Improved Ergonomics disclosed in U.S. Pat. No. 7,121,424, the disclosure of which is incorporated herein by reference, provide grooves adapted to accommodate fingers and/or thumbs. However, a significant shortcoming from such conventional devices is that a user must use both hands to hold both a plate and a beverage container, which prevents a user from eating with a utensil while holding both the plate and the beverage container. In addition, conventional apparatuses fail to allow the user to balance a food area of a plate with a beverage that is securely held on another, opposing area of the plate.

There is a long felt need for an apparatus that securely holds a plate, a beverage and utensils with one hand. The present invention provides such an apparatus and method.

SUMMARY OF THE INVENTION

The present invention provides a product that focuses on consumer familiarity with a standard-size round plate design (of standard volume) with a minimum possible extension of elements for accommodating a cup holder, thumbholes and other features. In a preferred embodiment, that plate has teardrop shape with an outer rim that mimics a utensil opening design and provides a familiar point of reference to the user. Features include a rim design that mimics the openings of the fork holders, as described in detail below.

BRIEF DESCRIPTION OF THE DRAWINGS

The above and other objects, features and advantages of certain exemplary embodiments of the present invention will be more apparent from the following detailed description taken in conjunction with the accompanying drawings, in which.

DETAILED DESCRIPTION OF THE PREFERRED EMBODIMENTS

Figure 1:
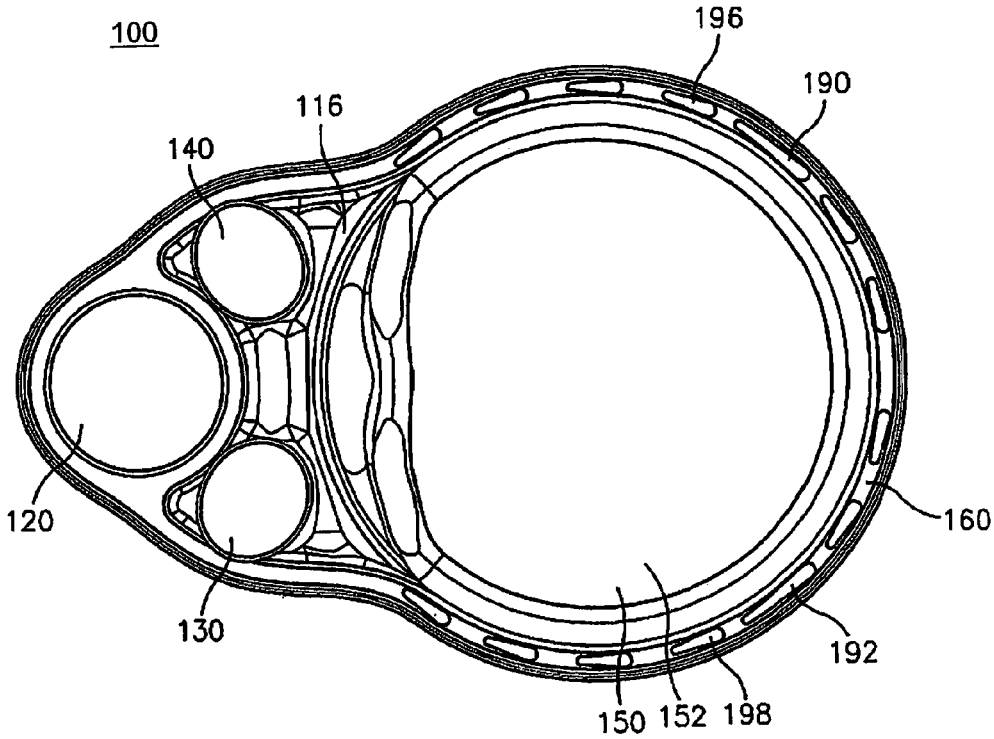
FIG. 1 is a top plan view of a plate according to an exemplary embodiment of the present invention.

The following detailed description of preferred embodiments of the invention is provided with reference to the accompanying drawings. In describing the invention, explanation about related functions or constructions known in the art are omitted for the sake of clearness in understanding the concept of the invention, to avoid obscuring the invention with unnecessary detail.

The present invention allows the user to stand when there is no seat available and hold a plate 100, napkin (not shown), utensil 610, and cup in one grasping hand (not shown) while freeing the other hand (not shown) to shake hands or hold something else. Cup hole 120 functions as a cup holder for a standard-size cup. In a preferred embodiment, a turned-down reinforced tubular lip designed to better sustain the weight of a filled cup. The cup holder may in a further embodiment further include a cup shield 470 to provide a barrier between the cup and the grasping hand grasping the plate. The cup shield 470 preferably further includes vertical ridges 474 or bumps 472 to reduce a surface contact area of an inserted cup contacting the cup shield 470. A separate insertable beverage sleeve 480 of a frusto conical shape for insertion in the cup holder is provided in a further embodiment, for holding a non-tapered standard cylindrical beverage container 464 in the cup hole 120.

Fork holders that allow the user to situate a standard-size fork 610 in the horizontal position by inserting one fork tine through a cut-through 190 to a position under the plate 100, leaving the remaining fork tines remain above the plate. In this position, the fork 610 is secured onto the plate 100, and the fork handle is conveniently presented to the user, further preventing a possibility of losing the fork 610 in windy environments or when the plate 100 is agitated by other means. In contrast, conventional designs place the fork 610 in the vertical position with all fork tines pointing straight up above the plate 100. Alternately, the current design avoids this orientation so the user does not need to touch a used fork 610 at any time during a meal by grasping the fork by its tines. The horizontal orientation is also specifically designed to avoid the awkward juxtaposition of a vertical fork orientation during social events and dinner parties where the outward appearance of eating utensils is distracting and inappropriate.

Chopstick holes 510, 512 may also be provided in a rim sidewall 188 surrounding an outer rim 160 of the plate, in order to situate standard-size chopsticks 514, 516 in the horizontal position by inserting each chopstick 514, 516 through two chopstick holes 510, 512.

In addition, a preferred use is of the thumbhole 130 closest to the user's chest and corresponding utensil opening 190 is that furthest away from the holder.

Thumbholes 130, 140 are provided to accommodate a user's thumb (not shown) past the second knuckle (the knuckle between the thumb and the palm), allowing a significantly deeper grip within the plate 100. The holes 130, 140 also include a turned-down lip so that the user's thumb can rest more comfortably within the hole 130. Cup hole 120 and thumbholes 130, 140 are rounded off and taper downwards to provide a snug but comfortable and not pinching, fit.

A thumb rise (i.e. an element closest to the thumb holes that resides within the circle of the plate 100, itself) is usable as a thumb rest, an area to better grip the plate 100 with the thumb, and allows the thumb to be elevated away from foodstuff residing within the food contact area 150 of the plate 100.

A concave thumb rest 430 is provided for the thumb to rest upon and to act as a finger guide so that weight is distributed evenly and the user's hand placement is at its most comfortable, even when holding a full plate 100 and cup.

The convex index finger rests 440, 442 are provided on the underside of the plate 100 (below the thumb rise) and guide an index finger (not shown) around the plate 100, positioning the index finger so that it helps grip the plate 100 more effectively. The convex index finger rests 440, 442 can be easily identified from the topside of the plate 100, as there is a slight, visible indentation.

The plate is preferably ambidextrous with thumbholes 130, 140, convex index finger rests 440, 442, and utensil openings 190, 192, 510, 512 to accommodate both left and right handed users.

A specific relative position of the thumbholes 130, 140 and its relationship to the position of the convex index finger rests 440, 442 and the thumb rise is provided for effectiveness of use, i.e. in a paddle-shaped handle area 110 of the plate 100, where cup holder and thumbholes 130, 140 lie. These three elements provide the basis for the overall position of the hand itself. Moreover, properly positioning the hand provides a support structure between the thumb, index finger and wrist that helps sustain the weight of a filled, standard-sized cup. When the grasping hand is suitably oriented, the proximity between the back of the grasping hand and a cup is minimal, thereby addressing the static load upon the structurally weakest areas of the product.

In a further embodiment a detachable insertable stiffener 600 is provided, preferably for use with a disposable version of the plate of the present invention, wherein stiffener 600 is inserted below the rim 160 in order to alleviate stress and prevent bending of the plate 100. In a preferred embodiment, stiffener 600 encompasses handles and transition areas 110, 116, yet does not encircle the entire plate.

As shown in FIGS. 1-7, in a preferred embodiment, a plate 100 is provided that includes a handle area 110, a food-contact area 150, a transition area 116, a cup hole 120, and first and second thumb holes 130, 140. The transition area 116 is arranged between the handle and food-contact areas 110, 150 to separate these areas. In a preferred embodiment, the first and second thumb holes 130, 140 are each adjacent to the cup hole 120, such that cup hole 120 and the first and second thumb holes 130, 140 are located within the handle area 110 of the plate 100.

Figure 2:
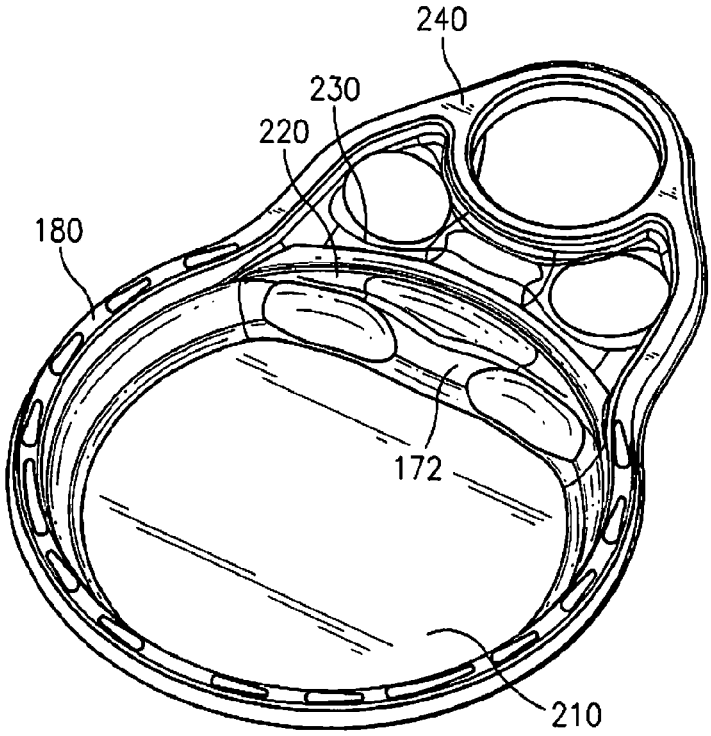
FIG. 2 is a perspective view of the plate of FIG. 1.
Figure 3:
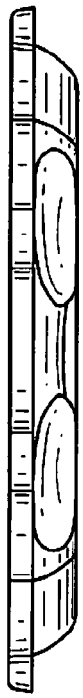
FIG. 3 is a side view of the plate according to the exemplary embodiment of the present invention.

As shown in FIGS. 1 and 2, a preferred embodiment provides components of plate 100 arranged at separate elevations 210, 220, 230, 240, with a common rim 160 at the highest elevation 240 surrounding and enhancing the structural integrity of the plate 100. As shown in FIG. 3, a food contact area surface 152 is provided at a first elevation 210; a second elevation 220 is provided above the first elevation 210; a third elevation 230 is provided above the second elevation 220; and a fourth, i.e. highest, elevation 240 is provided above the third elevation 230. In addition to the rim 160 surrounding the plate 100 at the fourth elevation 240, the transition area 116 is provided between the second and third elevations 220 and 230.

The cup hole 120 is preferably provided at the fourth elevation 240. A cup 470 may be inserted in the cup hole 120, allowing a user to carry both the plate 100 and the cup 470 with a single grasping hand 490.

The plate 100 preferably further includes a concave thumb-rest 430 at the second elevation 220. When a thumb of the grasping hand is inserted through one of the thumb holes 130, 140 from beneath the plate 100, an end of the thumb can be placed on the concave thumb rest 430 to ease grasping of the plate 100, preventing the thumb from extending into the food contact area 150. The shape of the thumb holes 130, 140 is not limited to the shape illustrated in FIGS. 1-6. The thumb holes 130, 140 may be circular bit is preferably elliptical or teardrop shaped to ergonomically accommodate the grasping hand.

Figure 4:
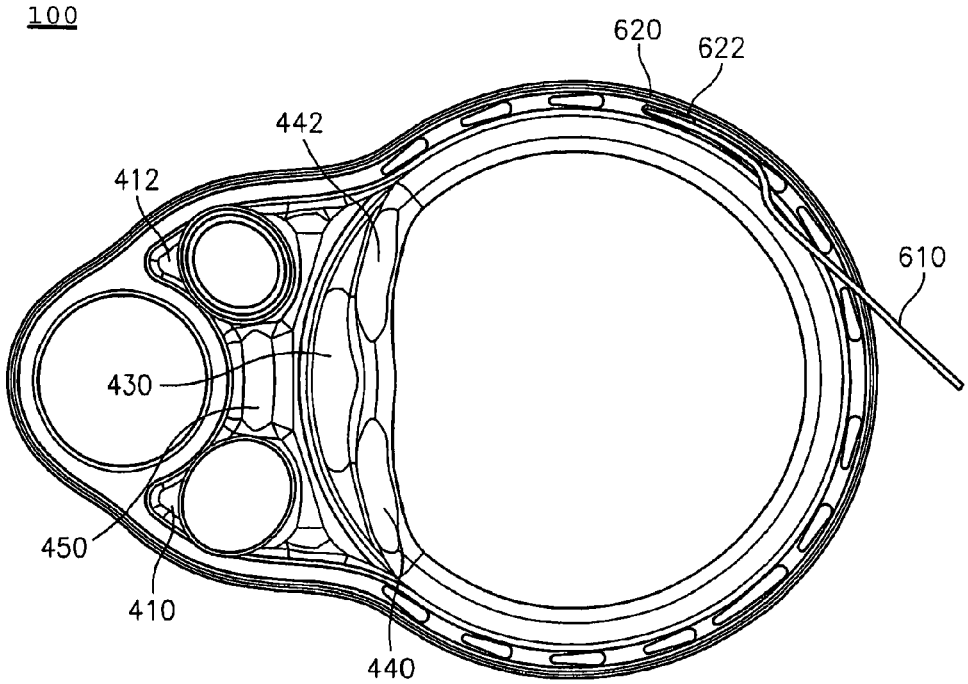
FIG. 4 is a top plan view of the plate of FIG. 1 taken along lines A-A.

The plate 100 further includes a convex knuckle-rest 450, which is provided at the third elevation 230, between the first and second thumb holes 130, 140. A side of the thumb can rest along the convex knuckle-rest 450 to further support the thumb. The plate 100 further includes a convex index finger rest 440, which is provided beneath the second elevation 220. An end of the index finger of the inserted grasping hand can rest within the convex finger rest 440 to further east grasping of the plate 100. The plate 100 may further include a second convex index finger rest 442, which is provided to facilitate ambidextrous use of the plate 100. As shown in FIG. 4, the convex index finger rests 440, 442, which are provided in a first sidewall 172 adjacent to each of the food contact and handle areas 150, 110.

The plate 100 preferably further includes a rim 160 at the fourth elevation 240, such that the rim surrounds both the food contact 150 and handle 110 areas. The rim 160 is also continuous and uninterrupted.

Plate 100 shown in FIG. 4 depicts a further preferred embodiment having a plurality or cut-throughs 190, 192 in the rim 160, wherein the cut-throughs 190, 192 are configured to support a fork 610 used while eating. One or more concave fork depression 196 are included in the rim 160, adjacent to the cut-throughs 190, 192. The fork depressions adjacent to the cut-throughs are preferably shaped to match the shape of a tine 612 of a fork 610 when inserted through the adjacent cut-through 190. The fork depressions 196 are preferably oriented such that a first end of the fork depression 196, which is closest to the handle portion 110, is below a surface of the rim 160, and that an second end of the fork depression 196 is at a surface of the rim 160, and such that the second end of the fork depression 196 is wider than the first end of the fork depression 196.

Figure 5:
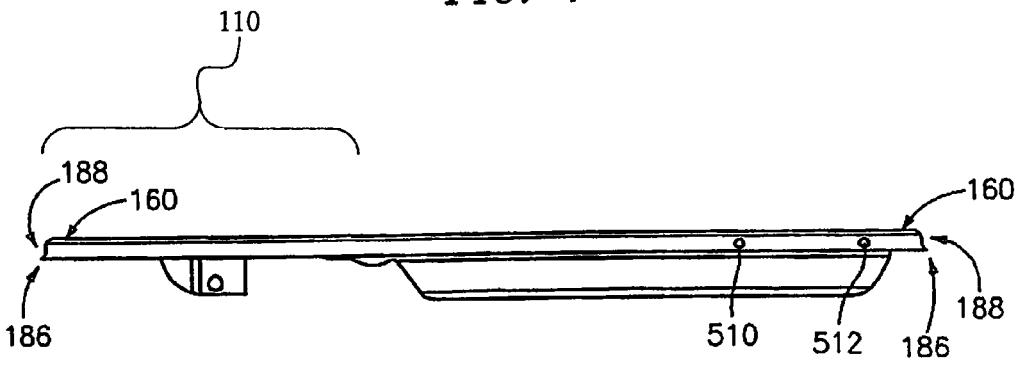
FIG. 5 is a profile view of the plate of FIG. 1.
Figure 6:
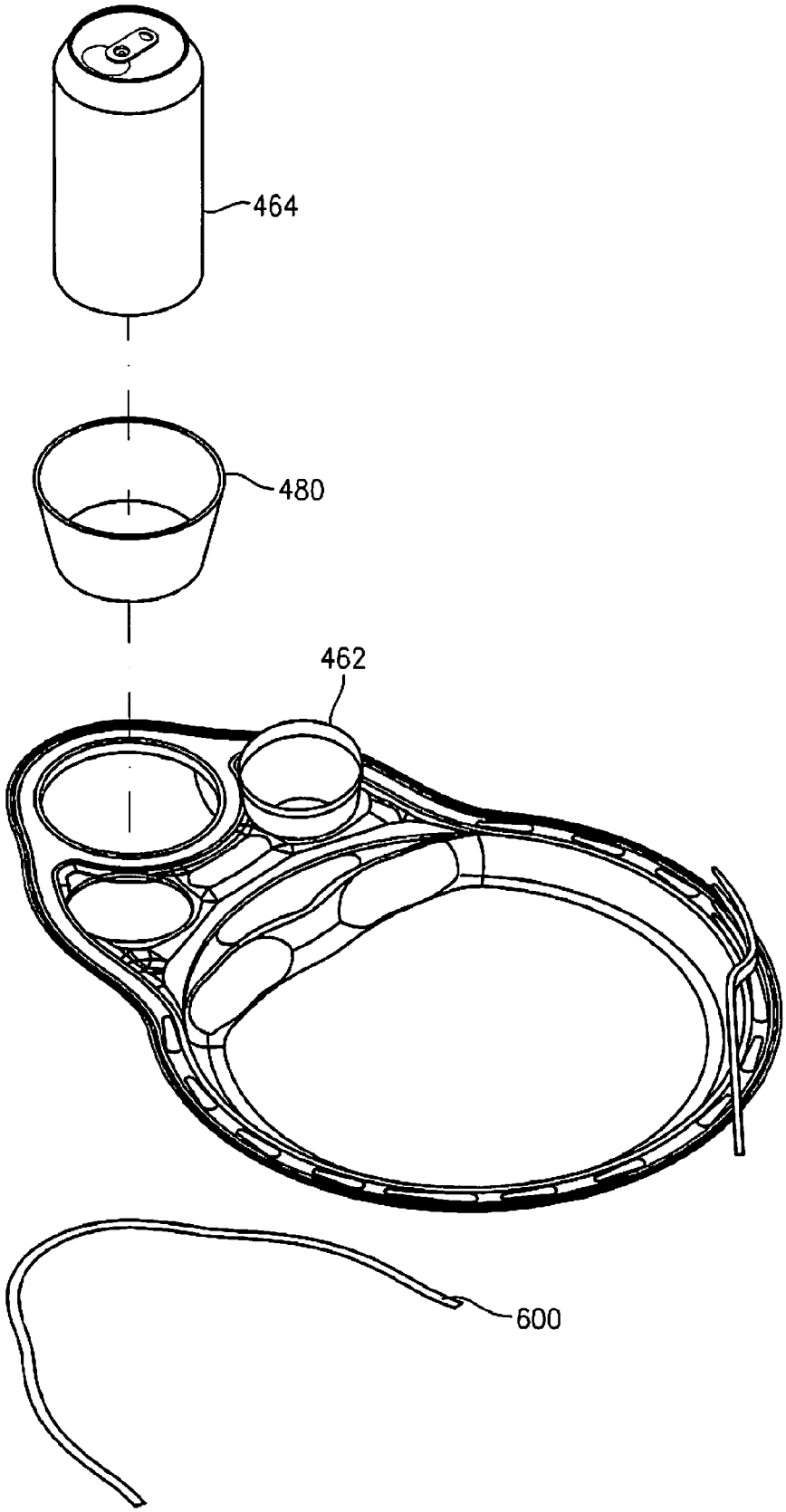
FIG. 6 is a perspective view of the plate showing a fork, beverage container, beverage sleeve, ramekin and stiffener.

As shown in FIG. 5, plate 100 further preferably includes a rim sidewall 188 extending downward from the rim 160. In a still further preferred embodiment, as shown in FIG. 6, plate 100 further includes an insertable planar stiffener 600, wherein the stiffener 600 is configured to be inserted beneath the rim 160 to prevent the rim 160 from bending. The stiffener may have a shape similar to the rim 160 or a portion of the rim 160, such that the stiffener will support areas of the plate 100 most subject to stress and bending due to a weight of food and utensils in the food contact area 150 and/or containers in the handle area 110.

Figure 7:
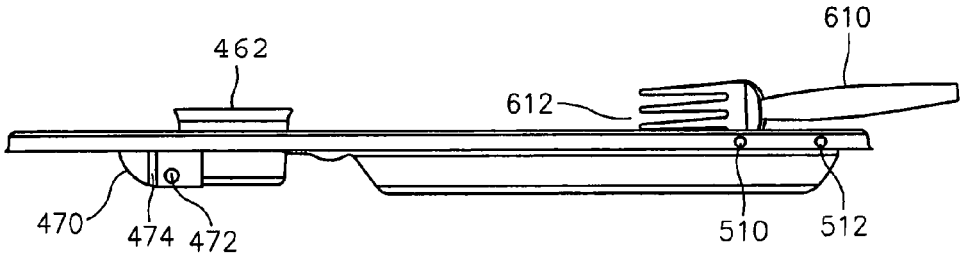
FIG. 7 is a front view of the plate showing a fork and ramekin.

As shown in FIG. 7, the plate 100, further includes at least two chopstick holes 510, 512 provided in the rim sidewall 188, wherein the chopstick holes 150 are configured to support chopsticks 514, 516 used while eating. Chopsticks 514, 516 are inserted through opposing chopstick holes 510, 512 for storage, in a position allowing handles of the chopsticks 514, 516 to be readily accessible for immediate removal for eating.

As shown in FIGS. 6 and 7, the first and second thumb holes 130, 140 alternately function as a holder for a ramekin 462, a shot glass (not shown), or a napkin (not shown).

As shown in FIG. 5, a cup shield 470 extends at least partially around the cup hole 120, such that the cup shield 470 is configured to act as a barrier between a cup 460 inserted in the hole 120 and a grasping hand 490 holding the plate 100. The cup shield 470 may be corrugated with vertical shield ridges 474, or a plurality of shield bumps 472 may be provided in a surface of the cup shield 470. The shield ridges 474 and shield bumps 472 reduce an amount of a surface area of a cup 460 inserted in the cup hole 120 in contact with the cup shield 120. The reduced amount of surface area reduces friction between the cup 460 and the cup shield 470, allowing a user to more easily remove the cup 460 from the cup hole 120. Further, the reduced surface area lowers heat transfer between the cup 460 and the grasping hand 490 grasping the plate 100.

The reduced surface area even further reduces compensation formed on the cup shield 470, which may result from a placing cold liquid inside the cup 460.

According to another exemplary embodiment of the present invention, the cup shield 470 extends completely around the cup hole 420 and forms a partial cone (not shown), such that the cup shield 470 is configured to support a substantially cylindrical beverage container 464. Alternatively, the first exemplary embodiment of the present invention may include an insertable beverage sleeve 480, such that the beverage sleeve is a partial cone insertable into the cup hole 120 and configured to support a substantially cylindrical beverage container 464. The partial cone shape of the cup shield 470 and the beverage sleeve 480 allow a cylindrical beverage container, such as a soda can to be inserted through the cup hole 120, instead of the cup 460, while being supported by the plate 100.

A method for holding a drink and a food platter utilizing a single party plate 100 according to the present invention is described as follows. A user grasps the plate at a handle area 110, loads food onto a food-contact area 150 of the plate and then positions a beverage container 460 in a cup hole 120 of a handle area 110 of the plate 100, thereby balancing the plate 100 on one grasping hand 490, leaving the user's other hand 492 free.

The user's free hand manipulates an eating utensil, which may include a fork 610 and/or chopsticks (not shown) which can be stored in holes 190, 192, 510, 512 within the plate 100 when not in use. While the user holds the plate 100, a fulcrum for balancing the plate 100 is provided substantially at a transition area 116 located between the handle and food-contact areas 110, 150. The user grasps the plate with one grasping hand, allowing the other hand to operate eating utensils, hold the beverage container for drinking, or perform other activities, while the plate is securely held by the grasping hand grasping the plate 100. Further, the user balances the plate 100 by inserting a thumb of the user's grasping hand into one of first and second thumb holes 130, 140 positioned adjacent to the cup hole 120. The first and second thumb holes 130, 140 are located within the handle area 110 of the plate 100.

The plate 100 according to the present invention may composed of any or a combination of various materials including paper, cardboard, pressed sheet styrene, aluminum, ceramics, glass, hard plastics, various metals and alloys, etc. The materials may be selected in consideration of cost, durability, and other well-known factors such that the plate 100 may be disposable after a single or multiple uses, or the materials may be selected such that the plate 100 is non-disposable.

While this invention has been particularly shown and described with reference to preferred embodiments thereof, it will be understood by those skilled in the art that various changes in form and details may be made therein without departing from the scope of the invention encompassed by the appended claims.

What is claimed is:

1. A plate comprising:
a handle area;
a food-contact area;
a transition area between the handle and food-contact areas;
a cup hole;
first and second thumb holes adjacent to the cup hole;
a food contact area surface at a first elevation;
a second elevation above the first elevation;
a third elevation above the second elevation; and
a fourth elevation above the third elevation;
wherein a rim surrounding the plate is provided at the fourth elevation and the transition area is provided between the second and third elevations,
wherein the cup hole and the first and second thumb holes are located within the handle area,
wherein a concave thumb-rest is provided at the second elevation and the cup hole is provided at the fourth elevation, and
wherein a convex knuckle-rest is provided at the third elevation, between the first and second thumb holes.

2. The plate of claim 1, wherein the rim surrounds both the food contact and handle areas.

3. The plate of claim 2, wherein the rim is continuous and uninterrupted.

4. The plate of claim 2, further comprising one or more cut-throughs in the rim configured to support a fork used while eating.

5. The plate of claim 4, further comprising one or more concave fork depressions in the rim and adjacent to the cut-throughs, wherein each fork depression is configured to support a tine of a fork inserted through a corresponding adjacent cut-through.

6. The plate of claim 2, further comprising:
a rim sidewall extending downward from the rim; and
a planar stiffener insertable beneath the rim to prevent bending.

7. The plate of claim 6, further comprising chopstick holes in the rim sidewall.

8. The plate of claim 1, further comprising a cup shield vertical shield ridges insertable in the cup hole.

9. The plate of claim 8, wherein the cup shield is frusto conically shaped, to support a beverage container.

10. A plate comprising:
a handle area;
a food-contact area;
a transition area between the handle and food-contact areas;
a cup hole;
first and second thumb holes adjacent to the cup hole;
a food contact area surface at a first elevation;
a second elevation above the first elevation;
a third elevation above the second elevation; and
a fourth elevation above the third elevation;
wherein a rim surrounding the plate is provided at the fourth elevation and the transition area is provided between the second and third elevations,
wherein the cup hole and the first and second thumb holes are located within the handle area,
wherein a concave thumb-rest is provided at the second elevation and the cup hole is provided at the fourth elevation, and
wherein a convex index finger rest is provided beneath the second elevation.

11. The plate of claim 10, wherein the convex index finger rest is provided in a first sidewall adjacent to each of the food contact and handle areas.

12. A plate comprising:
a handle area;
a food-contact area;
a transition area between the handle and food-contact areas;
a cup hole;
first and second thumb holes adjacent to the cup hole;
a food contact area surface at a first elevation;
a second elevation above the first elevation;

a third elevation above the second elevation; and a fourth elevation above the third elevation;

wherein a rim surrounding the plate is provided at the fourth elevation and the transition area is provided between the second and third elevations, wherein the cup hole and the first and second thumb holes are located within the handle area, wherein a concave thumb-rest is provided at the second elevation and the cup hole is provided at the fourth elevation, and wherein a second convex index finger rest is provided to facilitate ambidextrous use of the plate.

* * * * *